US007686183B2

(12) United States Patent
Ziegler

(10) Patent No.: US 7,686,183 B2
(45) Date of Patent: Mar. 30, 2010

(54) CONTAINER LID AND HOLDER AND SYSTEM AND METHOD FOR ATTACHING A LID AND HOLDER TO A CONTAINER

(76) Inventor: Scott Ziegler, 932 Vista Del Monte Way, El Cajon, CA (US) 92020

( * ) Notice: Subject to any disclaimer, the term of this patent is extended or adjusted under 35 U.S.C. 154(b) by 513 days.

(21) Appl. No.: 11/450,985

(22) Filed: Jun. 12, 2006

(65) Prior Publication Data

US 2006/0278641 A1 Dec. 14, 2006

Related U.S. Application Data

(60) Provisional application No. 60/690,248, filed on Jun. 14, 2005.

(51) Int. Cl.
*A47G 19/22* (2006.01)
*B65D 25/28* (2006.01)

(52) U.S. Cl. ..... 220/740; 220/212.5; 220/710.5

(58) Field of Classification Search ..... 220/212.5, 220/710.5, 713, 737, 738, 740, 741, 743; 229/404, 906.1
See application file for complete search history.

(56) References Cited

U.S. PATENT DOCUMENTS 494,361 A 3/1893 Bonwick
2,317,046 A 4/1943 Nelson
2,438,299 A 3/1948 Relis
2,446,451 A * 8/1948 Allen ..... 215/11.1
2,497,197 A 2/1950 Allen
2,497,198 A 2/1950 Allen
2,599,630 A 6/1952 Hair
2,620,085 A 12/1952 Baldanza
2,760,665 A 8/1956 Zenker
2,767,871 A 10/1956 Shapiro
2,797,836 A 7/1957 Kurkjian
2,852,054 A 9/1958 Brunson
2,892,559 A 6/1959 Raiche
2,949,204 A 8/1960 Bryant
2,958,439 A 11/1960 Yochem
3,088,767 A * 5/1963 Deal ..... 294/31.2
3,120,912 A 2/1964 Mouth et al.
3,235,117 A 2/1966 Mason (Continued)

FOREIGN PATENT DOCUMENTS

EP 057559 A1 8/1982

(Continued)

*Primary Examiner*—Anthony Stashick
*Assistant Examiner*—James N Smalley

(57) ABSTRACT

An apparatus, system and method for attaching a lid to a beverage container is provided. In one embodiment a lid is positioned over the container opening and fastened to a first bead located around the opening. The lid also fastens to a second bead that is either located on the container, or located on a collar that is positioned adjacent to the first bead. The collar may extend around the container, or it may only extend partway around the container. The collar may be removable and may also include a handle. This Abstract is provided for the sole purpose of complying with the Abstract requirement rules that allow a reader to quickly ascertain the subject matter of the disclosure contained herein. This Abstract is submitted with the explicit understanding that it will not be used to interpret or to limit the scope or the meaning of the claims.

6 Claims, 9 Drawing Sheets

U.S. PATENT DOCUMENTS 3,269,575 A 8/1966 Hammes
3,286,864 A 11/1966 Patterson
3,297,187 A 1/1967 Thiesen
3,302,644 A 2/1967 Kennedy et al.
3,407,956 A * 10/1968 Linkletter et al. ..... 215/306
3,416,688 A 12/1968 Fanning
3,458,164 A * 7/1969 Massey ..... 248/145.6
3,612,322 A 10/1971 Linkletter
3,690,498 A 9/1972 Harbauer
3,766,975 A 10/1973 Todd
3,787,547 A 1/1974 Stephan
3,851,783 A 12/1974 Braginetz
3,858,741 A 1/1975 Smith, Sr.
3,860,135 A 1/1975 Yung et al.
3,986,627 A 10/1976 Zapp
3,990,596 A 11/1976 Hoftman
4,303,170 A 12/1981 Panicci
4,388,996 A 6/1983 Panicci
4,399,921 A 8/1983 Kusz
4,420,089 A 12/1983 Walker et al.
4,420,101 A 12/1983 O'Neill
4,494,672 A 1/1985 Pearson
4,574,970 A 3/1986 Schwarz
4,810,245 A 3/1989 Aagesen
4,817,810 A * 4/1989 Shull ..... 220/741
4,844,270 A 7/1989 Coffman
4,850,496 A 7/1989 Rudell et al.
4,874,109 A * 10/1989 Cook ..... 220/758
4,883,192 A 11/1989 Krugman
4,941,579 A 7/1990 Lee
4,961,510 A 10/1990 Dvoracek
4,964,205 A 10/1990 Coffman
5,020,679 A 6/1991 Signorini
5,024,341 A 6/1991 Dekerle
5,036,993 A 8/1991 Ramsey
5,038,948 A 8/1991 Signorini
5,040,719 A 8/1991 Ballway
5,040,756 A 8/1991 Via Cava
5,050,759 A 9/1991 Marble
5,079,013 A 1/1992 Belanger
5,112,628 A 5/1992 Conrad
5,147,066 A 9/1992 Snider
5,253,781 A 10/1993 Van Melle et al.
5,284,261 A 2/1994 Zambuto
5,368,186 A 11/1994 Yeh
5,467,888 A 11/1995 Brandstrom et al.
5,474,199 A 12/1995 Julius et al.
5,480,043 A 1/1996 Wingo
D370,384 S * 6/1996 Shamis ..... D7/393
5,529,202 A 6/1996 Shamis
5,570,797 A 11/1996 Yeh
5,593,054 A 1/1997 Glynn
5,624,053 A 4/1997 Freek et al.
5,678,720 A * 10/1997 Van Melle ..... 220/287
5,702,025 A 12/1997 Di Gregorio
5,720,408 A 2/1998 Schmid et al.
5,758,787 A 6/1998 Sheu
5,765,716 A 6/1998 Cai et al.
5,791,503 A 8/1998 Lyons
5,884,786 A 3/1999 Valyi
5,919,420 A 7/1999 Niermann et al.
5,984,127 A 11/1999 Fenton
6,016,929 A 1/2000 Williams
6,047,852 A 4/2000 Evans et al.
6,056,142 A 5/2000 Elliott
6,112,926 A 9/2000 Fishman
6,216,909 B1 * 4/2001 Lin ..... 220/739
6,260,723 B1 7/2001 Bergholtz
6,311,865 B1 11/2001 Laurent
6,571,981 B2 6/2003 Rohlfs
6,578,726 B1 * 6/2003 Schaefer ..... 220/253
6,581,972 B2 * 6/2003 Nojima et al. ..... 283/81
6,601,728 B1 8/2003 Newkirk et al.
6,607,092 B2 8/2003 Manganiello et al.
6,622,882 B2 9/2003 Smith
6,705,485 B1 3/2004 Sato et al.
6,745,915 B2 6/2004 Rees
6,752,287 B1 6/2004 Lin
6,755,318 B2 6/2004 Burke et al.
2001/0035387 A1 11/2001 Sutcliffe-Noyd
2002/0104816 A1 8/2002 Feldman et al.
2002/0158075 A1 10/2002 Caldicot et al.
2003/0066839 A1 4/2003 Connors et al.
2003/0192891 A1 10/2003 Ziegler
2004/0005511 A1 1/2004 Goddard et al.
2004/0056040 A1 3/2004 Ziegler
2004/0124196 A1 7/2004 Ziegler

FOREIGN PATENT DOCUMENTS

EP 585818 A1 3/1994
GB 2181062 A 4/1987
JP 1126922 A 11/1987
WO WO 93/09037 5/1993

* cited by examiner

CONTAINER LID AND HOLDER AND SYSTEM AND METHOD FOR ATTACHING A LID AND HOLDER TO A CONTAINER

Priority is claimed to provisional application Ser. No. 60/690,248, filed Jun. 14, 2005, entitled "Lid and Holder for Disposable Cups," which is referred to and incorporated herein in its entirety by this reference.

FIELD OF THE INVENTION

The present invention generally relates to closures for containers, and more particularly to a closure and handle configured for attachment to a conventional cup.

BACKGROUND OF THE INVENTION

Most parents of infants and young children are very familiar with drinking cups often referred to as "sippy" or "sip" cups. Sip cups as currently known in the art typically comprises a cup portion which is fabricated from a plastic material and formed in the same general shape as a conventional paper drinking cup. In addition to this cup portion, the sip cup includes a lid which is engageable with the top rim of the cup portion. The lid itself typically includes an elongate spout which protrudes from a peripheral portion of the top surface thereof and includes a flow opening therein which fluidly communicates with the interior of the sip cup. In certain sip cups, the lid is threadably engaged to the cup or to a collar holding the cup. In other sip cups, the lid is frictionally engaged to the cup portion or to an annular collar holding the cup. Unfortunately, these lids are expensive to make and often do not provide an adequate fluid seal. In take-out eating establishments such as coffee shops, fast-food restaurants, amusement park concession stands, etc., beverages are often provided in a paper or plastic drinking cup. The drinking cup is typically provided with a plastic lid enclosure on one end thereof to contain the liquid within the cup, the lid enclosure including a short spout for drinking. If held by hand, the temperature of the drink can make the person's hand uncomfortably hot, or cold, as the case may be. If a holder is provided, it must usually be disposable or else it risks becoming soiled with use. But disposable cup holders are expensive and create liter. There is thus a need for a way to hold disposable drinks in a cost effective manner.

A number of coffee shops sell refillable cups, especially to regular customers who buy coffee or other drinks on a regular basis. But the coffee or other beverages leave a residue in the cup and thus require cleaning. There is thus a need for a cup holder that reduces the need for cleaning.

Figure 1:
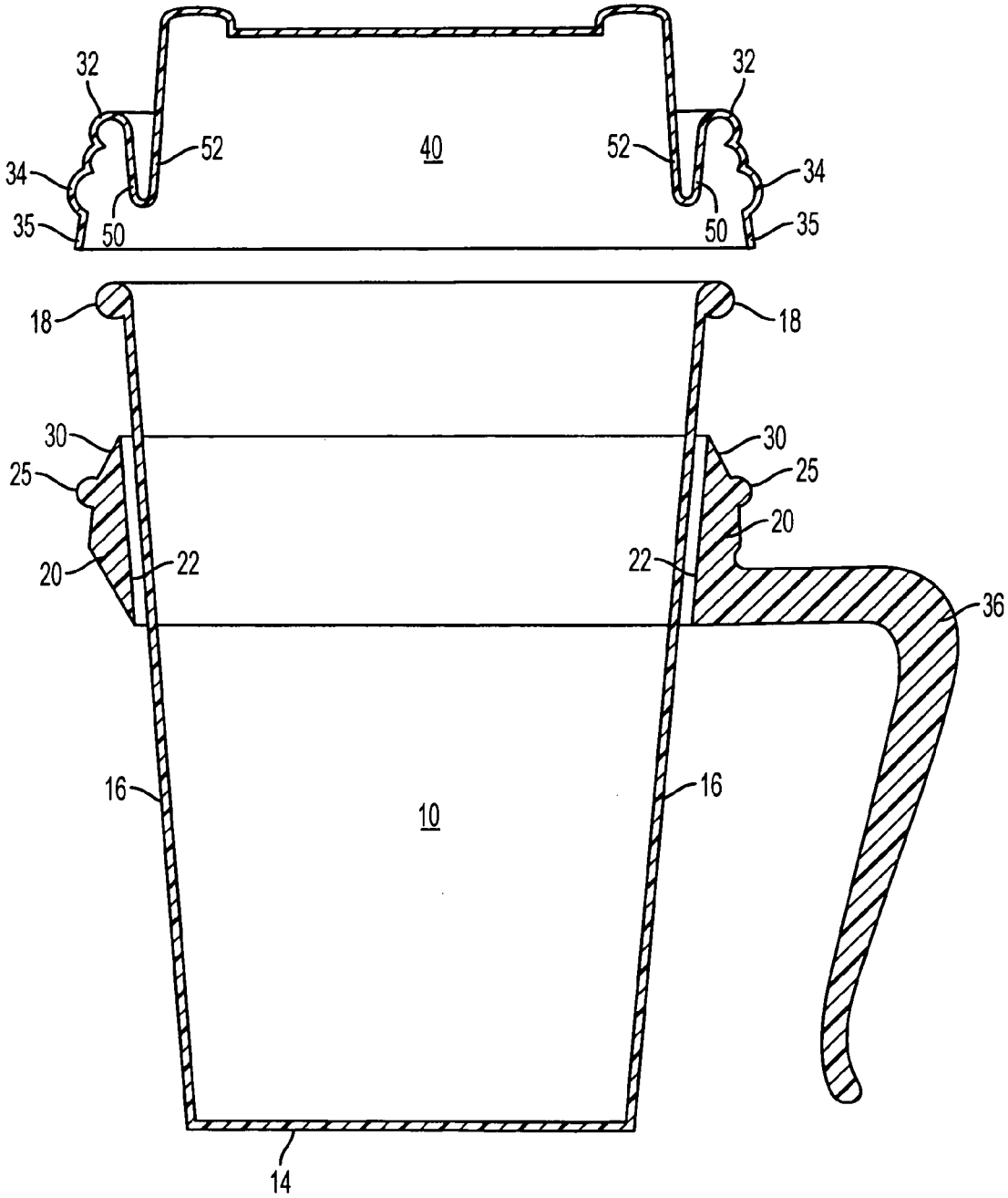
FIG. 1 is a sectional view showing a disposable cup, a first embodiment of a cup lid, and a first embodiment cup holder.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE PREFERRED EMBODIMENTS

In the following paragraphs, the present invention will be described in detail by way of example with reference to the attached drawings. While this invention is capable of embodiment in many different forms, there is shown in the drawings and will herein be described in detail specific embodiments, with the understanding that the present disclosure is to be considered as an example of the principles of the invention and not intended to limit the invention to the specific embodiments shown and described. That is, throughout this description, the embodiments and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

One embodiment of the present invention may be employed with a conventional disposable cup, or other type of fluid, or beverage container having a bead located about the periphery of an opening of the cup. A cup lid having a first annular recess engages with the cup bead. A second annular recess in the cup lid engages with a second bead that is located on a collar that is positioned adjacent to the cup bead. In a preferred embodiment, the collar includes a handle, thereby eliminating the need for a consumer to grasp the hot, or cold cup.

In another embodiment of the present invention, a substantially cylindrical container only includes the second bead, with the cylindrical container sized to receive a conventional disposable cup having a bead located about the periphery of the cup. The conventional cup is positioned within the cylindrical container, and the cup lid having the first and second annular recesses engages with the cup bead and the second bead, respectively, on the cylindrical container. In this embodiment, the cylindrical container may or may not include a handle, and it may be open at both ends, or it may include a base that closes one end. An alternative embodiment may include a gripping surface, such as a dimpled surface, or a rubber or other suitable plastic surface on the cylindrical container.

Referring to FIGS. 1-7, a cup 10 has a bottom 14, sidewalls 16 and a bead 18 around the opening or open top of the cup 10. The sidewalls 16 are typically tapered at a slight angle to allow stacking of the cups, although the present invention may be employed in cups that do not have angled sidewalls 16. The cup 10 may be of the disposable type, which are typically made of paper with a rolled bead 18 as shown, or they can be made of various plastic materials with a rolled bead or solid bead. Disposable cup beads 18 typically have a generally circular cross-section, and that includes beads 18 with an oval shape as formed or as deformed during stacking and shipping, and that includes beads 18 with a rounded upper edge and a slightly flattened outer facing edge, or even a slightly flattened bottom edge. In addition, the present invention may be used with cups having beads 18 that comprise a flange, projection, or any non-circular cross-section, and with cups may not be disposable.

Figure 2:
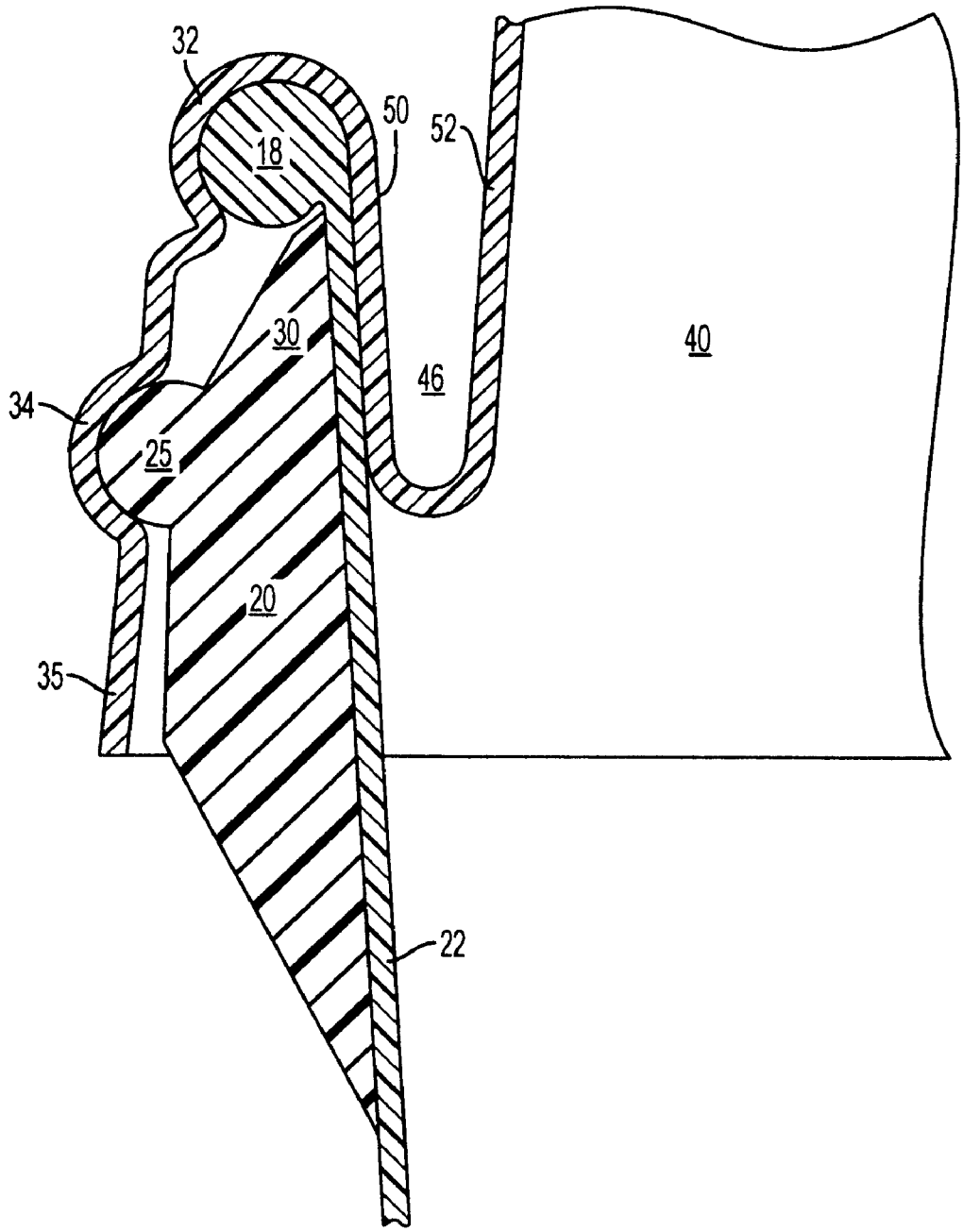
FIG. 2 is a sectional view of a portion of the disposable cup, a portion of the cup lid, and a portion of the cup holder illustrated in FIG. 1.
Figure 9:
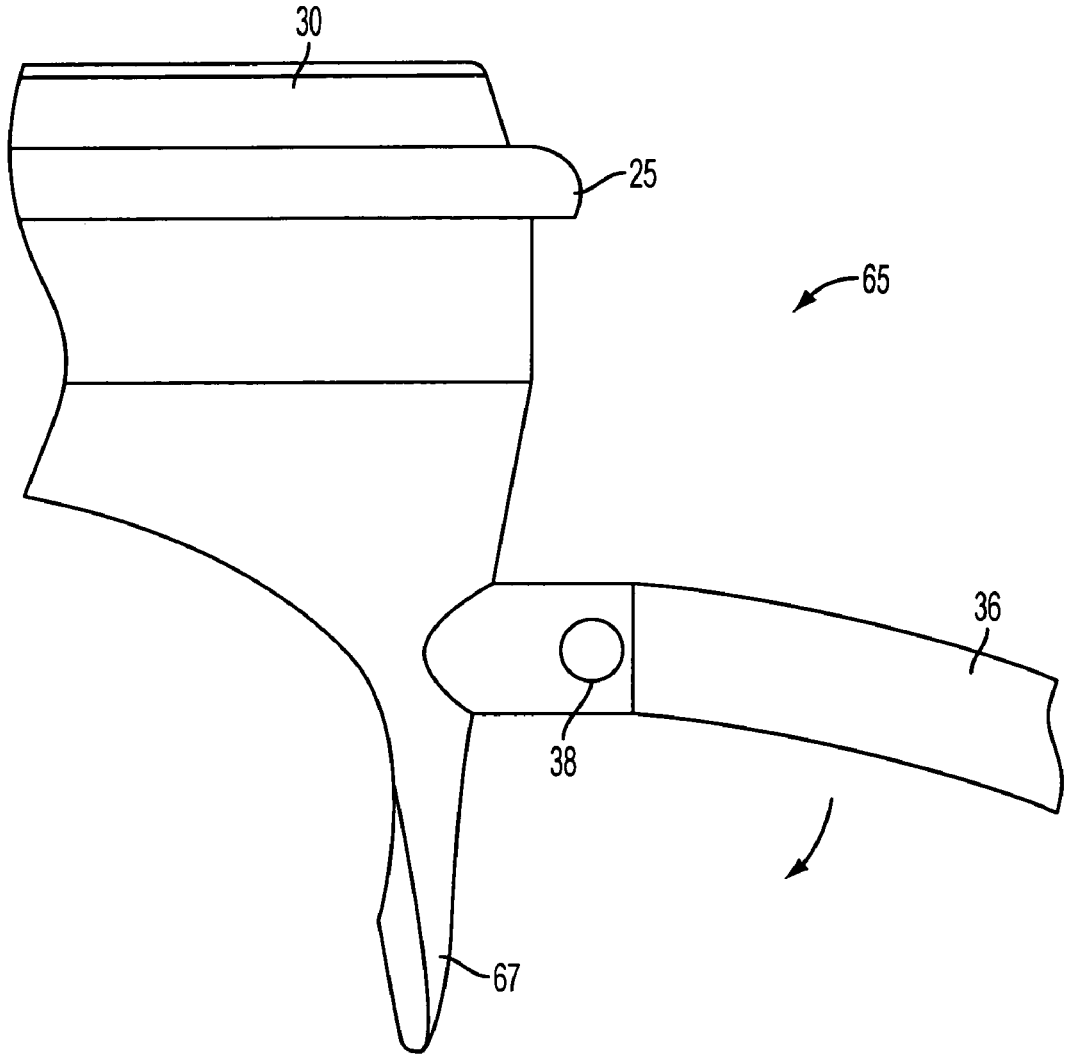
FIG. 9 is a partial elevation view of the cup holder comprising a partial collar and handle constructed according to a yet another embodiment of the present invention.

A collar 20 is provided with an inner surface shaped to engage the cup sidewalls 16. The inner surface is thus usually circular. In embodiments for use with angled cup sidewalls 16, the collar inner surface 22 is preferably, but optionally tapered at an angle that corresponds to the angle of taper of the cup sidewalls 16. The collar 20 also includes a projection, or locking surface 25 that may comprise several shapes. As shown in FIGS. 1 and 2, the locking surface 25 comprises a shape similar to the bead 18 on the cup 10, that is, a shape having a generally circular cross-section. An alternative shape for the locking surface 25 is shown in FIG. 9, which comprises a shape that does not have a circular cross-section. It will be appreciated that the shape of the locking surface 25 may comprise a flange, a projection, a lip, or any protruding rim, edge, or rib that is used to hold a lid 40 in place.

The collar 20 also includes an extension 30 on its upper end. The extension 30 engages the bead 18 when the collar 20 is placed about the cup 10. In one embodiment, a tip area of the extension 30 engages the lower inner quadrant of the generally circular cup bead 18, as shown in FIG. 2. One feature of the collar extension 30 is that by engaging under the cup bead 18, the cup bead 18 is supported, which prevents the cup bead 18 from collapsing during use. For example, a child may squeeze the cup 10, which without the support of the collar 20 and collar extension 30, may cause the cup 10 to collapse. Another feature of the present invention is that it now allows very large cups to be made of paper, rather than plastic. This is because large paper cups generally collapse due to the cup bead 18 weakness. For example, paper cups generally do not exceed 18 ounces in capacity. Larger capacity cups are made from plastic, which is more expensive to manufacture than paper cups. Because the collar extension 30 supports the cup bead 18, preventing collapse of the cup 10, large capacity paper cups can now be manufactured.

Figure 4:
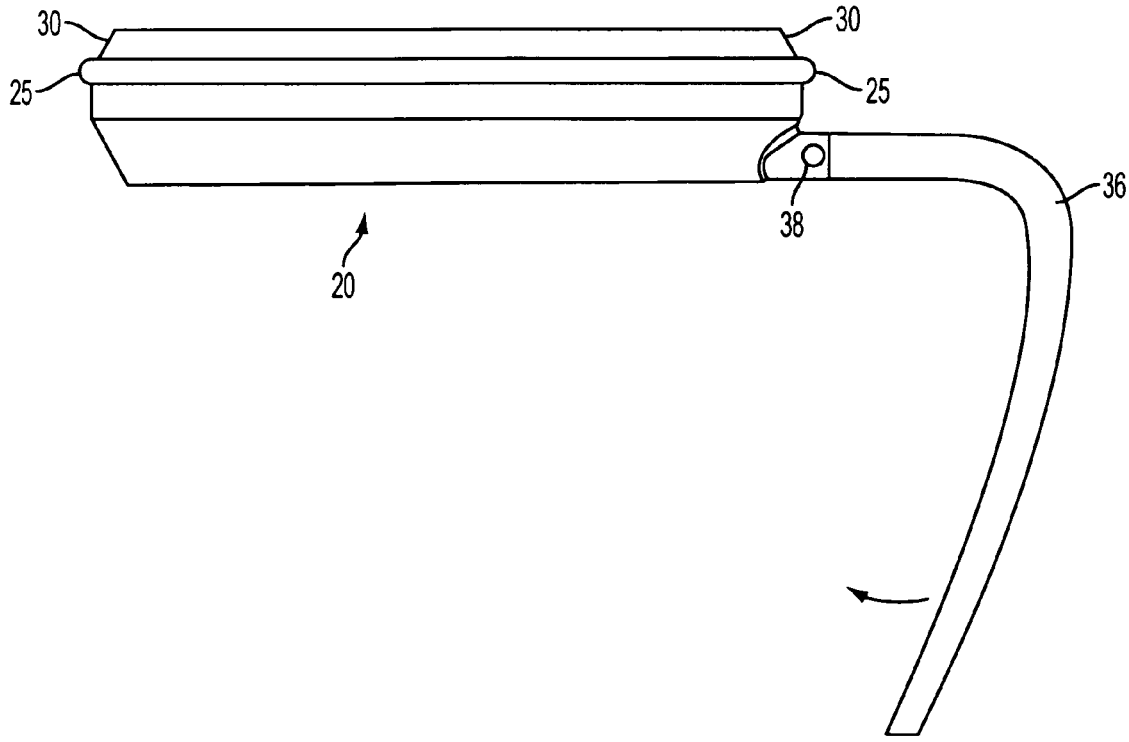
FIG. 4 is an elevation view of the embodiment illustrated in FIG. 3.

The collar 20 may optionally includes a handle 36, and may have more than one handle 36 if configured for use by infants or persons with impaired manual dexterity. Instead of a handle 36, a textured gripping surface or a surface shaped to increase the ease and/or efficiency of gripping (e.g., vertical or horizontal ridges) may be employed. As shown in FIG. 4, the collar 20 may also include a handle hinge 38, which allows the handle 36 to pivot as shown by the arrow. This embodiment allows the handle 36 to pivot toward the collar 20, making the collar 20 and handle 36 easy to carry in a purse, backpack, briefcase, or other type of handbag. In another embodiment the handle hinge 38 may include a locking feature, or element that keeps the handle 36 positioned adjacent to the collar 20 and/or in the deployed position, as illustrated in FIG. 4. The locking feature may comprise a notch, or detent, or other arrangement within the handle hinge 38 that increases the effort required to rotate the handle hinge 38 away from the collar 20 into the position illustrated in FIG. 4. Another embodiment collar 20 may include a handle 36 that has a tip, or distal end that contacts the cup sidewalls 16 when the collar 20 is positioned around the cup 10 (not shown). In this embodiment, the distal end provides support against the cup sidewalls 16, thereby stabilizing the handle 36 and collar 20. Yet another embodiment of the collar 20, whether it includes the handle 36, or not, is that it may be manufactured from biodegradable material, as well as and other materials, such as polymers, polyesters, polyolefins, polycarbonates, polyamides, polyethers, polyethylene, polytetrafluoroethylene, silicone, silicone rubber, polyurethane, polyvinyl chloride, polystyrene, stainless steel, aluminum alloys, and metal alloys.

As used herein, inner or inward refers to a direction toward a longitudinal axis of the cup 10, and outer or outward refers to the opposite direction. Upper refers to a direction along the longitudinal axis from the cup 10 toward the lid 40, and lower refers to the opposite direction, and above or below are with reference to the relative positions along the longitudinal axis of the cup 10 using the same orientation as "upper" and "lower."

A closure or lid 40 fastens to the top of the cup 10. In a preferred embodiment, the lid 40 is made of thin, vacuum formed plastic, typically styrene, and is typically about 0.015-0.020 inches thick. However, it will be appreciated that the lid 40 may be made of biodegradable materials, and other materials, such as polymers, polyesters, polyolefins, polycarbonates, polyamides, polyethers, polyethylene, polytetrafluoroethylene, silicone, silicone rubber, polyurethane, polyvinyl chloride, polystyrene, stainless steel, aluminum alloys, and metal alloys.

Figure 5:
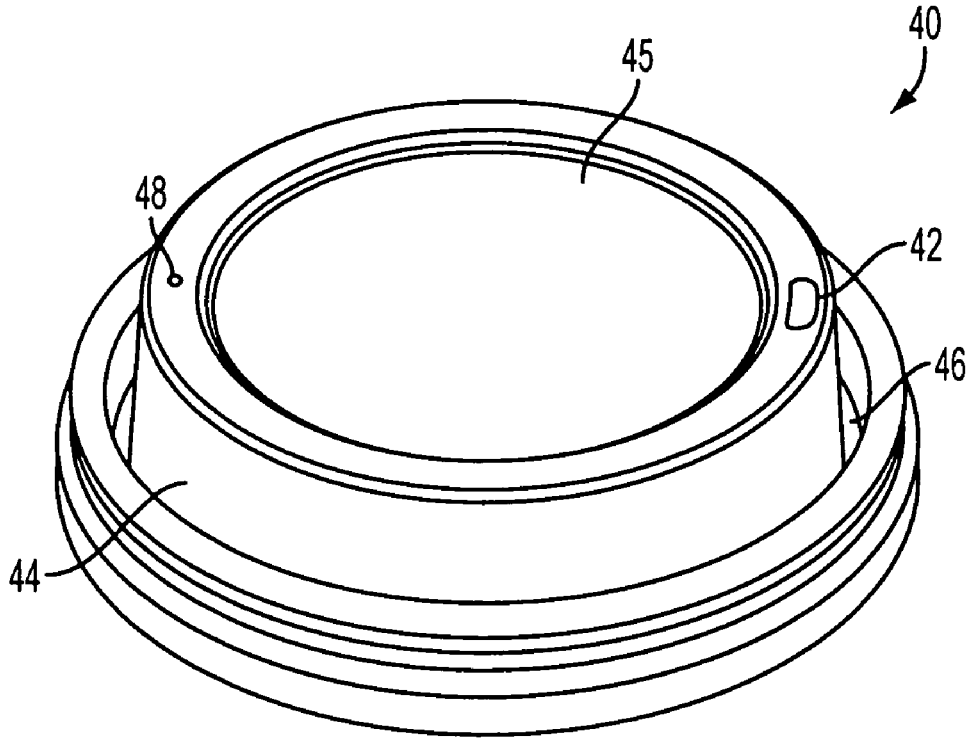
FIG. 5 is a perspective view of a cup lid constructed according to one embodiment of the present invention.

In one embodiment, as shown in FIG. 5, the lid 40 has a raised area 44 with at least one aperture 42 that allows fluid passage or is sized to receive a drinking straw (not shown). The aperture 42 allows liquid within the cup 10 to pass outside the cup 10. In another embodiment, the raised area 44 forms a spout, or other shaped opening which places the aperture 42 above the rim of the cup 10. For example, in one embodiment, a spout sized for a child is envisioned. For a child, the spout is preferably a defined spout small enough to fit in a child's mouth. For an adult, the spout may form an annular ring extending around the entire periphery of the cup adjacent the bead 18, with drinking apertures 42 located at one, or more places for drinking. Other embodiment lids 40 may include apertures 42 that have covers (i.e., flapped covers) which can be deflected, or otherwise moved, or removed, to allow passage of fluid. In another embodiment, the lid 40 may be shaped allow a user to both drink directly from the lid 40, and also to drink from a straw (not shown) that may be located in another aperture, or opening in the lid 40. For example, the lid 40 may include a first opening sized to receive a straw, and a second, larger opening sized to receive the lips of a user, so that a user would have the option of drinking from a straw, or drinking directly from the lid 40. This feature may be helpful when consuming "frozen" drinks, that comprise ice cubes, or smaller ice particles in the form of crushed ice, or a blended slush made of partially melted ice or very small particles of crushed ice.

Referring again to FIG. 5, in one embodiment, the lid 40 has an inner or interior recess 45 within the raised area 44 (both forming a cap), and an outer or exterior recess 46 outward of the raised area 44. The interior recess 45 has a bottom which is located so it is above the rim of the cup bead 18 when the lid 40 is fastened on the cup 10. A vent opening 48 is optionally located opposite the lid aperture 42 to allow air pressure to equalize between the inside and outside the cup 10 when the lid 40 is on the cup 10, in order to allow liquid to flow smoothly through the lid aperture 42. The interior recess 45 can also collect liquid that may spill from the lid aperture 42. The interior recess 45 may be a larger depression, as shown in FIG. 5, or in other embodiments, can be a localized depression in the lid 40 adjacent to a spout (not shown).

In the embodiment shown in FIG. 5, the outer recess 46 preferably extends around the entire circumference of the lid 40, so that when it is placed on the cup 10, the outer recess 46 is immediately adjacent to the bead 18. Referring to FIG. 2, in this embodiment, the outer recess 46 extends below the rim of the cup 10 and preferably below the center of the bead 18. In the illustrated embodiment, the outer recess 46 extends below the bottom of the bead 18, but other embodiments may not extend as far. This embodiment of the lid 40 that includes an outer recess 46 may be suitable for larger size cups 10, as the outer recess 46, in conjunction with the collar extension 30, support the cup bead 18, and keep it from collapsing. However, smaller cups 10 may not need an outer recess 46 (and the support it provides) and thus it will be appreciated that an outer recess 46 may not be included in all embodiments of the present invention. As shown in FIGS. 1 and 2, the support provided by the outer recess 46 is from a cup wall 50 that supports the cup bead 18, and the adjacent upper cup portion. The cup wall 50, and inner wall 52 form the outer recess 46.

Figure 6:
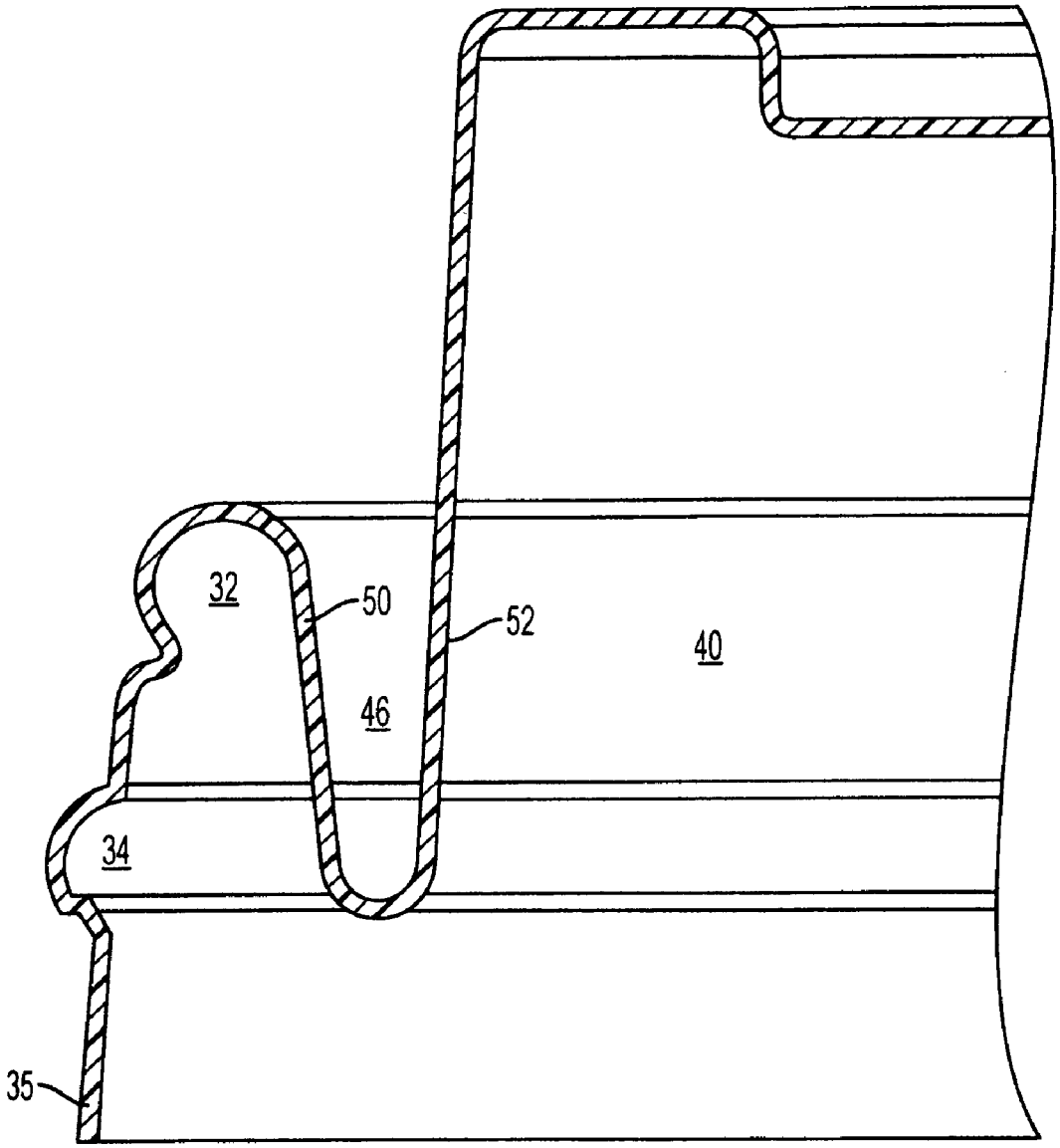
FIG. 6 is a sectional view of a cup lid constructed according to another embodiment of the present invention.

Referring now to FIGS. 2 and 6, the cup wall 50 of the lid 40 extends past the upper portion of the cup 10, forming a first recess, or bead recess 32. The first recess 32 is sized to receive the cup bead 18, as shown in FIG. 2. In a preferred embodiment, the first recess 32 engages the cup bead 18 in a "snap-fit" caused by the first recess 32 elastically deforming slightly when the cup bead 18 is inserted into the first recess 32. As illustrated in FIGS. 2 and 6 the first recess 32 is substantially circular and describes a truncated circle of about 220 degrees (where 360 degrees is a complete circle). However, it will be appreciated that the shape of the first recess may vary to correspond to different cup bead 18 shapes. It will also be appreciated that the shape of the first recess 18 may vary even if the cup bead 18 does not vary from the illustrated shape. For example, the first recess 18 may be substantially "U-shaped," thus describing only a 180 degree truncated circle, or it may not be circular at all, but may comprise two walls sized to capture the cup bead 18. In one embodiment, the first recess 32 provides a resilient gripping force (i.e., a first lock, or locking area or a first engaging area) to the cup bead 18 that prevents fluid within the cup 10 from escaping (i.e., a fluid tight seal).

Adjacent to the first recess 32 is the second recess, or second engagement area 34. In the embodiment illustrated in FIG. 2, a portion of the lid 40 extends past the first recess 32 and forms the second recess 34. Similar to the first recess 32, the second recess 34 is substantially circular and describes a truncated circle of about 180 degrees (where 360 degrees is a complete circle). In the embodiment illustrated in FIG. 6, the second recess 34 includes a non-circular area, which is illustrated as flat, or planar, but may comprise other shapes, such as angled, or curved, or any combination of straight, angled or curved. For example, the shape illustrated in FIG. 6 is sized to receive a locking surface 25 that is not circular in cross-section, but instead may be a flange, a projection, a lip, or any protruding rim, edge, rib, or other shape.

Similar to the first recess 32, the second recess 34 is sized to form a "snap-fit" with the locking surface 25. However, this snap-fit may be caused by the second recess 34 elastically deforming slightly when the locking surface 25 is inserted into the second recess 34, or the second recess 34 itself may not deform, but the section of the lid 40 that extends from the first recess 32 to the tip of the lid 40 may deform. For example, as illustrated in FIG. 2, the tip of the lid 40 ends in a flange 35. As the collar 20 with the locking surface 25 is inserted into the lid 40, the flange 35, as well as the second recess 34 may deflect slightly to receive the collar 20 and locking surface 25. In a preferred embodiment, the second recess 34 provides a second locking, or engaging surface (in addition to the first recess 32) that additionally secures the lid 40 to the cup 10. In the illustrated embodiment (shown in FIG. 2), the diameter of the locking surface 25 is greater than the diameter of the cup bead 18. It will be appreciated that other embodiments may have the diameter of the locking surface 25 substantially equal to the diameter of the cup bead 18.

One feature of the present invention is that the lid 40 now has two locking surfaces (first recess 32 and second recess 34) that provide additional locking, or engaging force (when compared to conventional lids that only employ one engaging surface with a cup bead). This substantially eliminates instances where a cup full of liquid is lifted, or grasped by the lid only, and the lid separates from the cup, spilling the liquid, due to the weak engagement between the lid and cup. The double locking feature of the present invention virtually eliminates inadvertent separation of the lid 40 from a cup 10. This feature is especially helpful with children who attempt to pry a lid from a cup, often spilling the contents. Another feature of the present invention is that threading engagement between the cup and lid is eliminated and is replaced with a "snapping" engagement between the lid 40 and the cup 10, greatly increasing ease, and quickness of engagement between the lid 40 and the cup 10. Yet, the two locking surfaces (first recess 32 and second recess 34) provide the same fluid-tight capability and secure engagement offered by threads, but with less effort, and with substantially less manufacturing cost. For example, embodiments of the present invention may be vacuum formed, a process that is very cost effective, but which cannot be used to from threads. In addition, without threads, embodiments described herein comprising the collar 20 and handle 36, may rotate about the circumference of cup 10 freely, without "unthreading" or becoming separated from the cup 10.

As mentioned above, the lid 40 terminates in a flange 35 that is extends away from the cup 10, so as to ease removal of the lid 40 from the cup 10. That is, in one embodiment, the flange 35 angles away from the cup 10 sidewalls, providing an easily graspable surface for a person's fingers. It will be appreciated that the flange 35 may not be included in all embodiments of the present invention.

Figure 7:
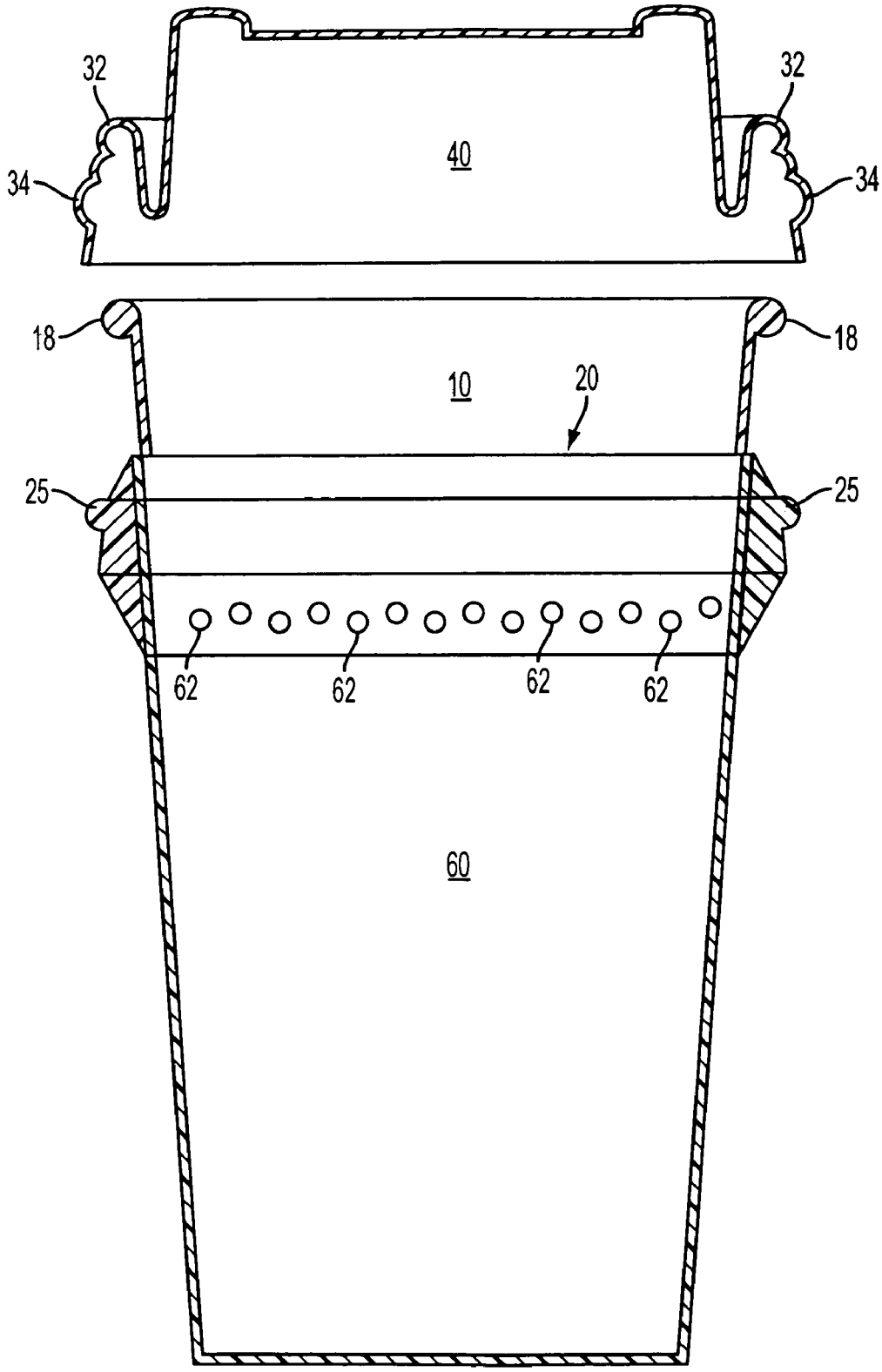
FIG. 7 is a sectional view showing a disposable cup, a cup lid as illustrated in FIG. 1, and an embodiment of the present invention in the form of a cup with an integrated collar.

Referring now to FIG. 7, which illustrates another embodiment of the present invention in the form of a non-disposable cup 60 that includes an integral collar 20. In one embodiment, the non-disposable cup 60 is sized to receive a disposable cup 10 having a bead 18. The non-disposable cup 60 may have a bottom, or the bottom may be eliminated, thus the non-disposable cup 60 may only include sidewalls. In a preferred embodiment, the non-disposable cup 60 includes an integrally attached collar 20 that may be substantially identical to the collar 20, or modified. For example, in one embodiment, an integral collar includes an annular locking surface 25 that is sized to engage the second recess 34 on the lid 40. When a disposable cup 10 is placed into the non-disposable cup 60, the periphery of the non-disposable cup 60 engages the cup bead 18, similar to the collar extension 30. A lid 40 is then placed over the disposable cup 10 and the non-disposable cup 60. The first recess 32 on the lid 40 engages the cup bead 18, and the second recess 34 on the lid 40 engages the locking surface 25 on the non-disposable cup 60. In this fashion, two separate locking, or engaging regions provide double security from fluid leakage as well as doubly securing the lid 40 to the cups 10 and 60.

As shown in FIG. 7, another embodiment non-disposable cup 60 may include a modified collar 20 that includes grasping elements 62. As illustrated, the grasping elements 62 may be projecting dimples, or alternatively, the grasping elements 62 may be circular depressions, or they may be projecting ridges, depressed channels (not shown) or other suitable features that provide additional purchase for gripping the non-disposable cup 60. In addition, the collar 20, and/or the locking surface 25, as well as the grasping elements 62 may be constructed of a material having a high friction coefficient, such as rubber, plastic, a polymer, or any equivalents. The non-disposable cup 60 may be constructed of plastic, stainless steel, metal, metal alloys, aluminum alloys or other suitable materials. That is, the non-disposable cup 60 and its integral collar 20 may or may not be manufactured from the same material. In addition, another embodiment non-disposable cup 60 may include a handle 36 that may or may not include a handle hinge 38 that may or may not include the locking features described above in connection with FIGS. 3 and 4. In another embodiment, the non-disposable cup 60 may, in fact, be disposable. That is, the cup 60 may be made from paper, or other material so that the cup 60 would be disposable.

In use, a cup 10 is placed in the collar 20, with or without liquid already in the cup 10. If the cup 10 contains hot liquid, such as coffee, the purchaser can now grasp the handle 36, and thereby directly avoid holding the hot cup 10. With the collar 20 and collar extension 30 now positioned adjacent to the cup bead 18, as described above, the lid 40 can be placed over the cup 10. The first recess 32 on the lid 40 engages the cup bead 18, and the second recess 34 on the lid 40 engages the locking surface 25 on the collar 20 (in a "snap-fit" as described above). In this fashion, two separate locking, or engaging regions provide double security from fluid leakage as well as doubly securing the lid 40 to the cup 10. In addition, the collar 20 provides support to the cup 10, preventing collapse of the cup 10. When the fluid is consumed, the user can pull the collar 20 down toward the base of the cup 10, unlocking the collar 20 from the lid 40, or the lid 40 can be removed from the cup 10 by grasping the flange 35. The disposable cup 10 and lid 40 may then be discarded, and the collar 20 can be re-used. Or, in another embodiment, the collar 20 (with or without handle 36) may also be disposable, that is, designed for a one-time-use.

Alternatively, the lid 40 may be snapped onto the bead 18 of the cup 10, and the cup is then inserted through the opening of the collar 20 until the lid snaps onto the collar 20. Specifically, the first recess 32 on the lid 40 engages the cup bead 18, and the second recess 34 on the lid 40 engages the locking surface 25 on the collar 20. In this fashion, two separate locking, or engaging regions provide double security from fluid leakage as well as doubly securing the lid 40 to the cup 10. The collar 20 also supports the cup bead 18, preventing collapse of the cup 10. When the fluid is consumed, the user can remove the lid 40 from the cup 10 by grasping the flange 35. Once the lid 40 is removed, the cup 10 and collar 20 are easily separated. The disposable cup 10 and lid 40 may then be discarded, and the collar 20 can be re-used.

Figure 3:
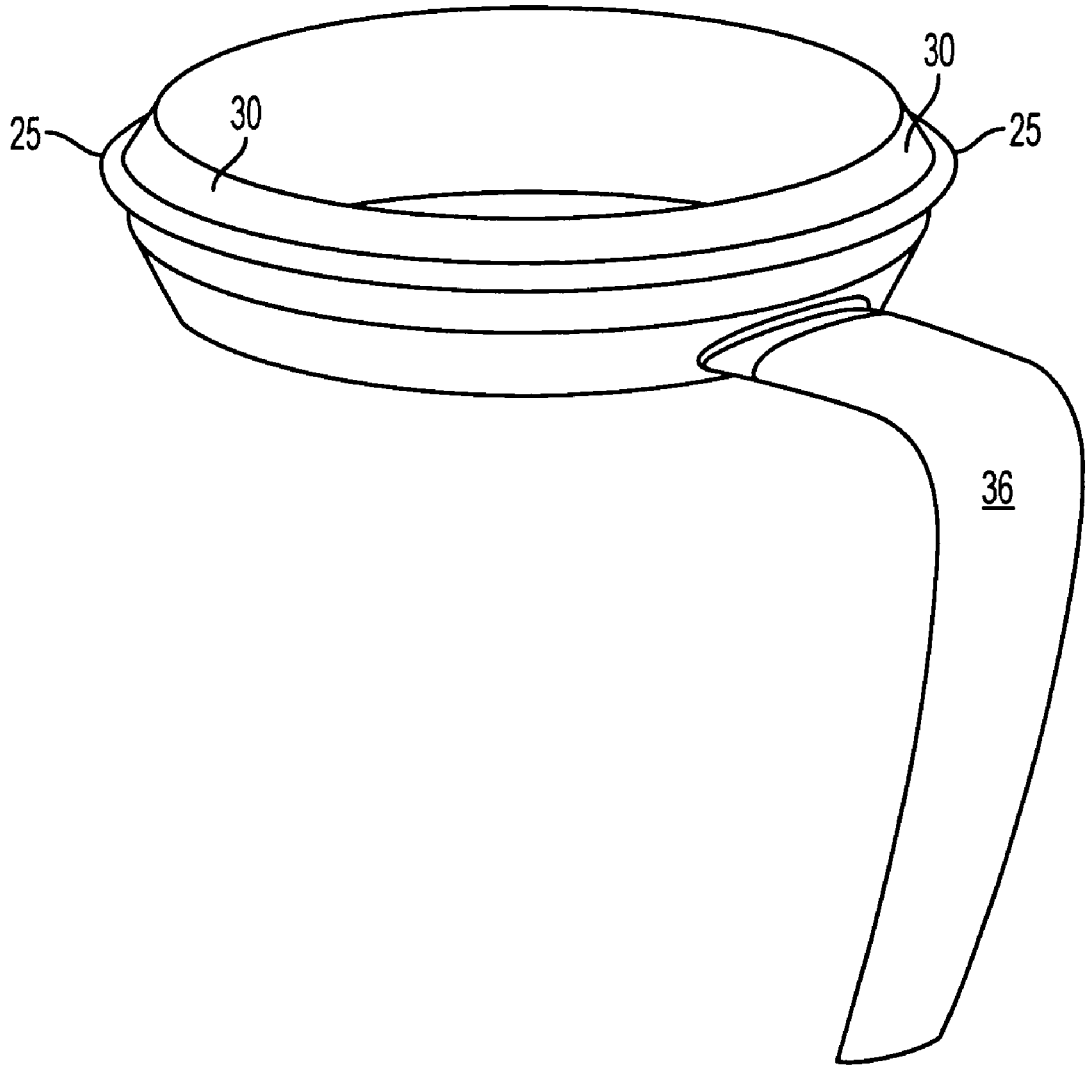
FIG. 3 is a perspective view of a collar and handle constructed according to one embodiment of the present invention.
Figure 8:
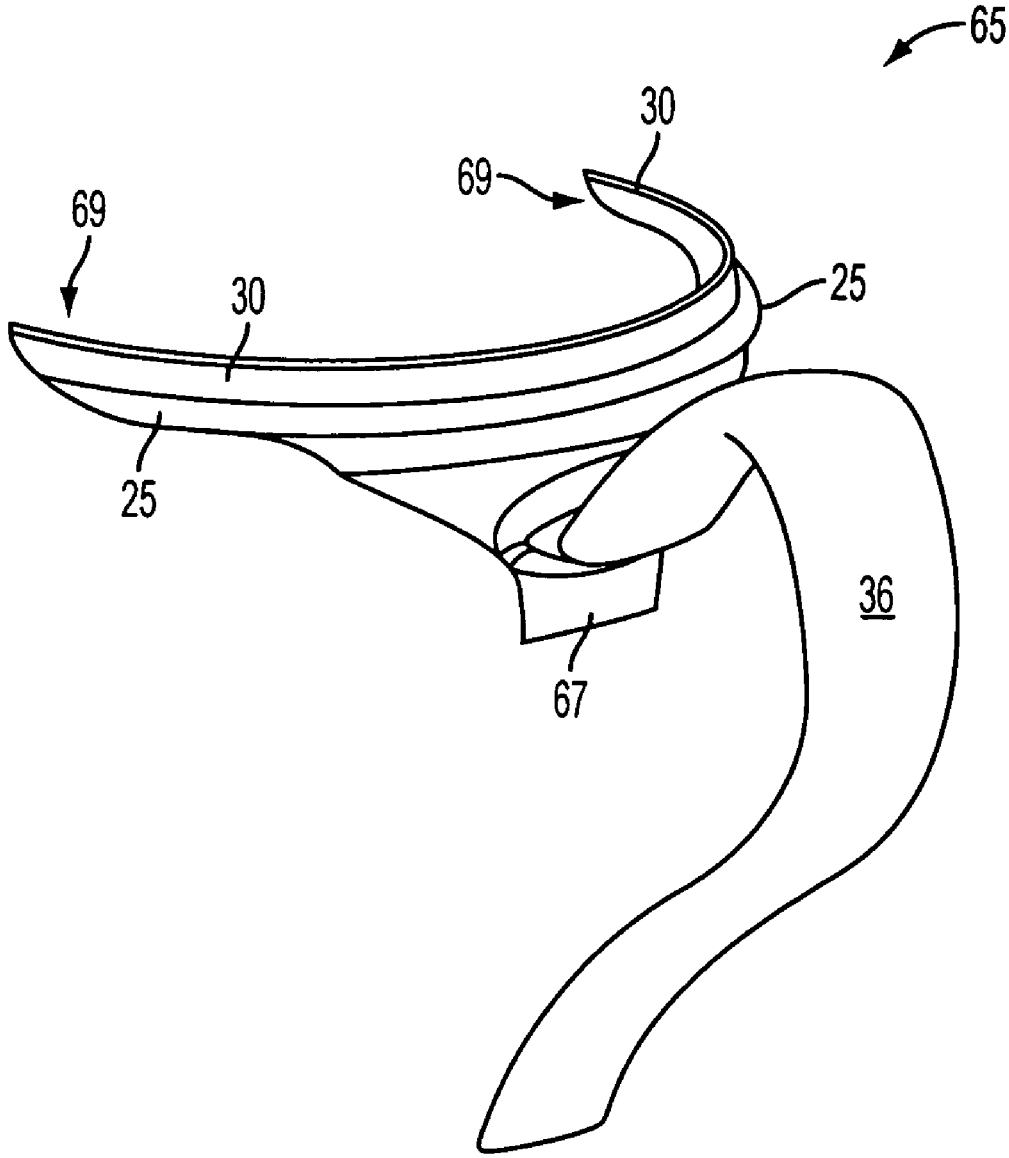
FIG. 8 is a perspective view of cup holder comprising a partial collar and handle constructed according to a further embodiment of the present invention.

Referring now to FIGS. 8 and 9, another embodiment of the present invention in the form of a partial collar 65 is illustrated. As shown, the partial collar 65 does not comprise a complete ring like collar 20, but instead comprises a curved ¼ arc, ⅓ arc, ½ arc, or other sized arc. That is, instead of a collar 20 that completely circumscribes, or encircles a container as illustrated in FIGS. 3 and 4, this embodiment of the invention does not extend completely around the perimeter of a container or cup 10. This embodiment of the invention may be sized to fit any cup, and the fingers 69 which extend from the handle 36 around the cup (not shown) may deflect to fit different cup circumferences. It will be appreciated that this embodiment of the invention includes any length of fingers 69, ranging from fingers 69 that would only circumscribe less than ¼ of a cup's perimeter, or circumference, to fingers 69 that would almost meet, thereby circumscribing all but a small portion of the cup's circumference (for example, a ¼ inch or less). The partial collar 65 includes many of the features found in the collar 20, and also functions similarly. The partial collar 65 includes a collar extension 30, that when placed against a cup 10, abuts the cup bead 18 as shown in FIG. 2. In addition, the partial collar 65 also includes the locking surface 25 that engages the second recess 34 on the lid 40, as also illustrated in FIG. 2, and described above.

Referring to FIG. 9, this embodiment of the partial collar 65 includes a hinge 38 so that the handle 36 can pivot as shown by the arrow. In addition, this embodiment includes a locking surface 25 that is not circular in cross-section, but instead includes a small shelf, or planar projection that aids in securely engaging with the lid 40. It will be appreciated that the shape of the locking surface 25 may comprise a flange, a projection, a lip, or any protruding rim, edge, or rib that is used to hold a lid 40 in place. As shown in both FIGS. 8 and 9, the partial collar 65 may include an optional brace, or extension 67, that projects downward from the base of the handle 36. This optional element may provide additional stability and support when the partial collar 65 is positioned against a cup sidewall 16, as the brace 67 contacts the cup sidewall 16. Because the fingers 69 of the partial collar 65 do not extend around the entire circumference of a cup 10, the method of installing and removing the partial collar 65 is simpler than the collar 20, described above. For example, one method comprises attaching the lid 40 to the cup 10, and then positioning the partial collar 65 against the cup sidewall 16 and moving the partial collar 65 upward so that the locking surface 25 engages with the second recess 34 on the lid 40. The collar extension 30 functions as described above in connection with the collar 20, supporting the cup bead 18, thereby preventing the collapse of the cup 10. In addition, the locking surface 25, in conjunction with the second recess 34, provides an additional locking, or engaging region (the first being the bead 18 and the first recess 32) to provide double security from fluid leakage as well as doubly securing the lid 40 to the cup 10. Alternatively, the partial collar 65 may be installed by first placing the collar extension 30 underneath the cup bead 18, as shown in FIG. 2, and then snapping the cup lid 40 over both the cup bead 18 and the locking surface 25, thereby engaging the first recess 32 and the second recess 34 with the cup bead 18 and the locking surface 25, respectively. As described above, this provides two separate locking, or engaging regions that provide double security from fluid leakage as well as doubly securing the lid 40 to the cup 10.

Another embodiment of the present invention includes an integral lid 40 and handle 36 (not shown). In this embodiment, the handle 36 with fingers 69 may be pivotally attached (by a hinge, or other means) to the lid 40 so that when the lid 40 is positioned over a cup 10, the handle 36 and fingers 69 may be rotated downward, with the locking surface 25 on the fingers 69 engaging the second recess 34 on the lid 40. This embodiment may, or may not be disposeable, and the hinge, or pivoting means may or may not include a locking feature as described above.

Both the collar 20 and the partial collar 65 may include additional features. For example, either embodiments 20 or 65 may include more than one handle 65, which may be helpful for senior citizens or children. Another feature may be a barcode or other type of identifier (and may also include a BLUETOOTH® functionality) that may be permanent, or temporary, and which may be located on the handle 36, or elsewhere. For example, a person may purchase either the collar 20 or partial collar 65 from a coffee, or other beverage purveyor, who places information on the collar 20 or partial collar 65, such as the consumers coffee preference. The information, in the form of a barcode, RF tag, or other information source, may be manufactured into the handle 36, or the collar 20 or partial collar 65, or the purveyor may provide a barcode dispenser, with stamp-like barcodes, that can be affixed to the handle 36, or collar 20 or partial collar 65, with different barcodes identifying different beverages.

Thus, it is seen that lid, collar and handle for a beverage container are provided. One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. A kit for a container having a bead around an opening, the kit comprising:

a ring comprising an annular locking surface comprising a substantially circular cross-section, with the substantially circular cross-section extending outwards from the ring, and an annular extension located above the annular locking surface, the annular extension having a distal portion that tapers to a distal end, with the distal end sized to be positionable adjacent to the bead;

a handle extending from the ring; and a lid comprising:

a cap including an aperture;

an annular base depending from the cap, the base having a first recess sized to engage the bead of the container to provide a first fastening engagement with the container; and a second annular recess adjacent to the first recess, the second recess sized to engage the annular locking surface, and provide a second fastening engagement.

2. The kit of claim 1, where the container bead is selected from a group consisting of: a bead having a substantially circular cross-section, a projection, a flange, and a locking surface.

3. The kit of claim 1, where the aperture is selected from a group consisting of: an opening, a opening covered with a moveable flap, an opening covered with a removeable element, a spout, an opening sized to receive a straw, and an opening sized to receive a users lips.

4. The kit of claim 1, further comprising a hinge located substantially between the ring and the handle, the hinge allowing a distal end of the handle to move toward the ring.

5. The kit of claim 1, further comprising a brace extending substantially from a base of the handle, the brace structured to abut a sidewall of the container.

6. The kit of claim 1, further comprising a barcode located on either the ring or the handle, the barcode structured to provide information selected from a group consisting of: information about an owner of the apparatus, information about a fluid to be placed in the container, and information about a method of payment for a fluid placed in the container.

* * * * *